US005824958A

United States Patent [19]

Higashikozono et al.

[11] Patent Number: 5,824,958

[45] Date of Patent: Oct. 20, 1998

[54] NOISE SUPPRESSING, COIL-TYPE ELECTRICAL CABLE RESISTANT TO HIGH VOLTAGE

[75] Inventors: Makoto Higashikozono; Hiroshi Inoue, both of Yokkaichi, Japan

[73] Assignee: Sumitomo Wiring Systems, Ltd., Japan

[21] Appl. No.: 721,317

[22] Filed: Sep. 25, 1996

[30] Foreign Application Priority Data

Sep. 28, 1995 [JP] Japan ..... 7/250714

[51] Int. Cl.[6] ..... H01B 9/02

[52] U.S. Cl. ..... 174/105 R; 174/120 SC; 338/66

[58] Field of Search ..... 174/105 R, 110 R, 174/120 SC, 122 R; 338/66, 214

[56] References Cited

U.S. PATENT DOCUMENTS

| | | | |
|---|---|---|---|
| 3,410,984 | 11/1968 | Sandford et al. | 338/214 X |
| 3,518,606 | 6/1970 | Barker | 338/214 X |
| 3,607,243 | 9/1971 | Eiselstein et al. | 420/466 |
| 3,807,969 | 4/1974 | Schoerner et al. | 420/537 |
| 4,016,010 | 4/1977 | Caron et al. | 148/682 |
| 4,435,692 | 3/1984 | Miyamoto et al. | 338/214 |
| 4,800,359 | 1/1989 | Yukawa et al. | 338/214 |
| 4,970,488 | 11/1990 | Horiike et al. | 338/214 |
| 5,057,812 | 10/1991 | Yukawa et al. | 338/66 |
| 5,059,938 | 10/1991 | Brown | 338/66 |
| 5,576,514 | 11/1996 | Fujimoto et al. | 174/110 R |

FOREIGN PATENT DOCUMENTS

| | | | |
|---|---|---|---|
| 1333494 | 12/1994 | Canada . | |
| 690459A1 | 3/1966 | European Pat. Off. | 174/110 R |

*Primary Examiner*—Bot L. Ledynh
*Assistant Examiner*—Chau N. Nguyen
*Attorney, Agent, or Firm*—Jordan B. Bierman; Bierman, Muserlian and Lucas

[57] ABSTRACT

A noise-suppressing, coil-type, electrical cable which is resistant to high voltage includes an elongated core and a helically wound resistance wire. An insulation layer is provided over the resistance wire on the core. The wire has a tensile strength of at least 100 grams force, an elongation to break of at least 15%, a diameter between about 45 and 70 $\mu$m, and a resistivity of approximately 10 to 50 $\mu\Omega\cdot$cm. There are at least 7,000 turns per meter of the wire wound around the core, and the cable has a resistance value of approximately 2 to 4 $\Omega$k/m. Cables of the foregoing type provide reduced resistance and maintain their ability to suppress noise.

12 Claims, 1 Drawing Sheet

NOISE SUPPRESSING, COIL-TYPE ELECTRICAL CABLE RESISTANT TO HIGH VOLTAGE

This Application claims the benefit of the priority of Japanese Application 7/250714, filed Sep. 28, 1995.

The present Invention is directed to a coil-type electrical cable which is resistant to high voltage and is capable of suppressing noise. It is comprised of an elongated core, carrying a helically wound resistance wire, having an insulation layer coated thereon. Cables of this type are used in vehicle ignition circuits and must have low electrical transfer loss, high heat and voltage resistance, and the ability to suppress noise resulting from electromagnetic waves generated by the ignition discharge in the vehicle engine.

BACKGROUND OF THE INVENTION

In order to generate sparks in the cylinders of an internal combustion engine, high voltages are necessary. Electrical current at such voltages is transmitted to the spark plugs directly or through a distributor. Particular types of cables are used for this purpose.

Such cables fall generally into two categories, i.e. cord-type and coil-type. The former comprise fibers which are impregnated with carbon and the latter consist of a core (often of a magnetic material) with a fine metallic resistance wire helically wound thereon. The present Invention is directed to the latter type. Such cables are described in Japanese Published Utility Models Hei 1/3225.3 and 6/6418. As to the former, the central core is made of an aramid fiber extruded with a coating of a kneaded mixture of 100 parts by weight of a base polymer and 300 to 700 parts by weight of a ferrite powder. The ferrite core has an external diameter which does not exceed 1.3 mm. The core is wound with 8,000 to 14,000 turns per meter of resistance wire. The whole is extrusion coated to form an insulation layer of polyolefin. This is then covered with a sheath for protection.

More specifically, the Application teaches the use of an aramid fiber of 1,500 denier coated with a mixture of chlorinated polyethylene and manganese-zinc ferrite. The resistance wire is nickel chromium with a diameter of 0.06 mm and a resistivity of 105 $\mu\Omega$cm. The Application further teaches that 9,600 turns per meter of the wire are helically wound on the core and the resistance value of the completed wire is 16 k$\Omega$/m.

As to the second Utility Model Application (Hei 6/6418), a similar elongated core is extrusion coated with silicon rubber mixed with ferrite powder. The resistance wire is stainless steel with a diameter of 0.055 mm which is dipped in an epoxy resin mixed with carbon. As a result, a semi-conducting resin coating is formed having a uniform thickness of 4 to 8 $\mu$m and a specific resistance of $10^2$ to $10^5$ $\Omega$cm. The coated wire is then wound around the core at a pitch of 14,000 turns per meter.

In recent times, great concern has arisen for protection of the environment. In particular, the exhaust gases generated by automobiles and the pollution resultant therefrom have come under strict regulation. In order to comply therewith, "lean-burn" engines have been developed. These engines require higher ignition energy compared to those which they replace. Therefore, the coil-type cables used to connect the ignition coil and spark plugs must not only be capable of suppressing noise and resisting high voltage, but also must have a resistance which is approximately half that of previously known cables.

This has been accomplished by reducing the number of turns per unit length applied to the cable. However, this also reduced the inductance of the cable which, in turn, diminished its ability to suppress noise. Alternatively, the reduced resistance was obtained by increasing the diameter of the resistance wire. However, when turns of such wire are wound closely around the core, there is a substantial risk of a short circuit therebetween. This results in a sharp decrease in resistance and lowering of the ability to suppress noise.

As is readily appreciated, the short circuit results if the distance between adjacent turns of the resistance wire is less than the diameter of the wire. To prevent such short circuits, this reference teaches coating a semi-conductive resin on the wire before it is wound around the core. However, this increases the cost and is thus economically unsatisfactory.

SUMMARY OF THE INVENTION

It is, therefore, an object of the present Invention to provide an electrical cable of the foregoing type which is not prone to loss of inductance. It is also among the objects of the present Invention to provide such a cable which has reduced resistance, yet maintains the ability to suppress noise which is comparable to known cables of higher resistance. This is accomplished without increasing the diameter of the wire and without reducing the number of turns of resistance wire per unit length.

The cable of the present Invention has an elongated core and a resistance wire helically wound therearound. An insulation layer is coated on the core over the resistance wire and, if desired, a sheath encloses the insulation layer.

The resistance wire has a breaking strength of at least 100 gram force (0.98N) and an elongation to its breaking point of at least 15%. The diameter ranges from about 45 to about 70 $\mu$m and its resistivity is from about 10 to about 50 $\mu\Omega\cdot$cm. There are at least 7,000 turns per meter of the wire wound around the core and the resistance value of the finished cable is about 2 to about 4 k $\Omega$/m.

In a preferred form of the Invention, the resistance wire is composed of nickel alloyed with aluminum, silicon, and/or manganese. More preferably, the nickel is alloyed with approximately 5% by weight of each of aluminum, silicon, and manganese.

The elongated core consists of a central element and a ferrite layer. Although the central element may be a single strand of aramid fiber, it is preferable that it be composed of a plurality of such fibers. Most desirably, three stranded aramid fibers are used, each having a gauge of approximately 1,000 denier. The ferrite layer usefully is a mixture of ferrite powder and a resin or rubber. The ferrite layer usually has a maximum external diameter of 1.3 mm.

The insulation layer can be made of, for example, silicon rubber and frequently has an external diameter which does not exceed 4.6 mm.

Most preferably, the insulation layer is surrounded by a glass fiber mesh which, in turn, is covered by a protective sheath. The latter has an external diameter of about 7 mm.

To produce the cable in accordance with the present Invention, the central element is provided, and the ferrite powder is mixed with resin and/or a rubber. The resulting mixture is extruded around the central element to produce the core member with a usual maximum external diameter of 1.3 mm. The resistance wire, of the type previously set forth herein, is helically wound around the core, there being at least 7,000 turns per meter. Thus, the completed conductor has a resistance value of 2 to 4 k$\Omega$/m. Thereafter, the insulation layer is coated over the resistance wire. When desired or appropriate, a protective sheath can be coated on top of the insulation layer, with or without a glass fiber mesh therebetween.

BRIEF DESCRIPTION OF THE DRAWINGS

In the accompanying drawing, constitute a part hereof, and in which like reference characters indicate like parts.

DETAILED DESCRIPTION OF THE INVENTION

Figure 1:
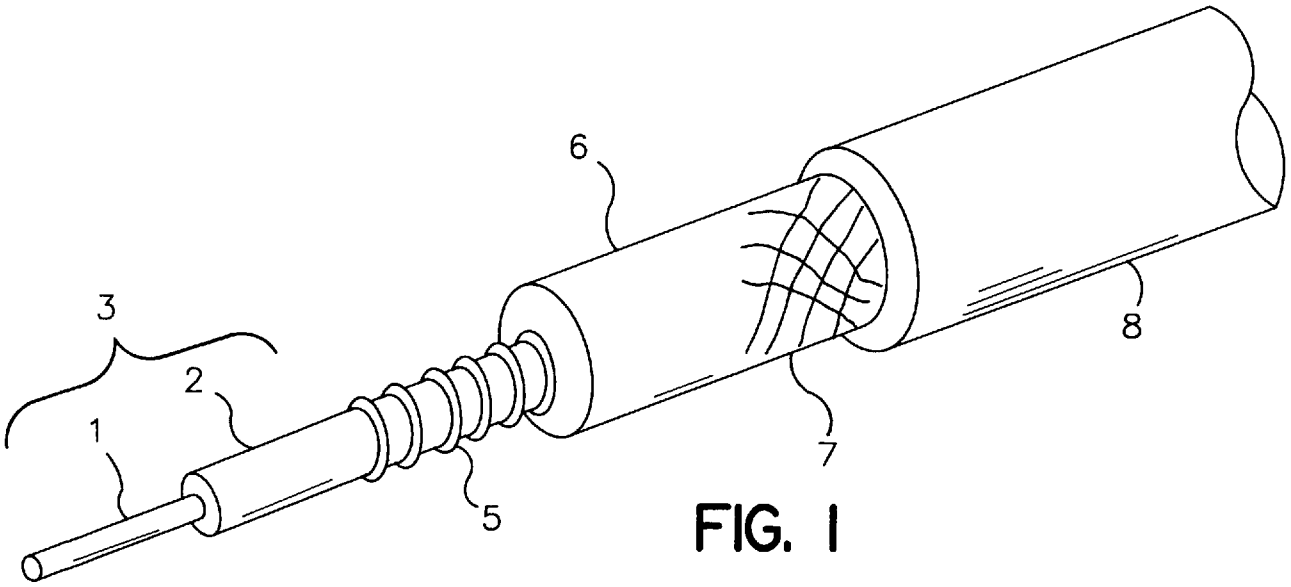
FIG. 1 is a perspective view of an ignition cable in accordance with the present Invention.
Figure 2:
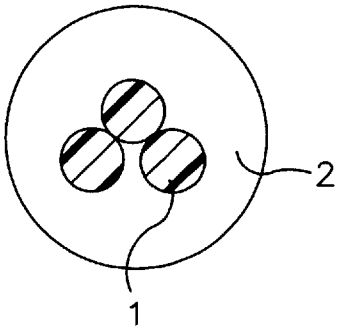
FIG. 2 is an end and side elevation of a core having three central elements.

The specific impedance Z of the cable according to the present Invention is given by the following equation $$Z=\sqrt{R^2+\left(2\pi fL-\frac{1}{2\pi fC}\right)^2} \quad \text{(I)}$$

wherein C is the electrostatic capacity of the cable, f is the frequency of the source of electricity, R is the resistance of the wire, and L is the inductance of the cable.

Generally, in the coil-type electrical cable, when the resistance R of the resistive wire is lowered, and the inductance L is maintained, the noise-suppressing capacity will be deteriorated, as evidenced by equation (I). Consequently, it is required to increase the inductance value L to prevent this deterioration.

On the other hand, the inductance L is given by the equation (II):

$$L=\pi^2\cdot d^2\cdot\mu s\cdot N^2\times 10^{-7}(\text{H/m}) \quad \text{(II)}$$

where, d is the diameter of an elongate core member; $\mu s$ is the magnetic permeability of the elongate core member; and N is number of spires.

In the equation (II), when the diameter of an elongate core member d is sized up while keeping the same outer diameter for the insulation coating, the latter becomes thinner, thereby increasing the electrostatic capacity of the electrical cable. If the outer diameter of the insulation coating is increased to counter this electrostatic increase, then dew will be formed on the surface of the electrical cable. The dew formed may increase the electrostatic capacity between the elongate core member and the engine body, against which said core member is positioned, thereby causing a drop in voltage at the ignition plug. When the magnetic permeability $\mu s$ is to be increased, it becomes necessary to increase the amount of ferrite powder. However, the ferrite-containing rubber is the less resistant to tensile force, has a smaller elongation and becomes susceptible to cracking even when submitted to small forces. Consequently, when working on end portions of the electrical cable, the resistive wire may be peeled off or cut off from the core element on which it is wound.

The conductor resistance value W is given by the equation (III):

$$W=\pi\times d\times N\times R(\text{k}\Omega/\text{m}) \quad \text{(III)}$$

where d and N have the same meaning as in the equation (II) and R is the resistance value of a wire defined by the equation (IV);

$$R=p\times L/A\ (\Omega/m) \quad \text{(IV)}$$

where p is the electrical resistivity, L is the length of an elongate core member around which the resistive wire is wound and A is the section of the resistive wire.

Thus, from the foregoing analysis, the most effective way to increase inductance L is to increase the number of turns per unit length of the resistance wire on the core. Accordingly, it has been determined that, in order to obtain a noise-suppressing ability at least equal to that of comparable known cables, a minimum of 7,000 turns per meter of resistance wire must be applied to the core. To avoid the necessity (and resultant expense) of coating the resistance wire, the diameter thereof should not exceed 70 $\mu$m. On the other hand, in order to provide adequate useful life of the cable, the diameter should preferably not be less than 45 $\mu$m.

It has also been determined that the resistance wire should have a breaking strength of at least 100 grams force and an elongation (to break) of at least 15%. If these requirements are not met, the winding of the turns of wire on the core cannot be properly carried out at high speed; thus, mass production is impaired and the difficulties thereof are increased.

In summary, the resistance wire, to provide adequate noise suppression and high-voltage carrying capacity, should have a diameter which does not exceed 70 $\mu$m, a tensile strength of at least 100 grams force, and an elongation to break of at least 15%. There must be at least about 7,000 turns of the resistance wire per meter of the core and preferably the diameter of the wire should be at least 45 $\mu$m. The foregoing requirements cannot be met by the usual resistance wires such as those formed of nickel/chromium, stainless steel, copper/nickel, and the like. The resistance wire of the present Invention, on the other hand, is preferably nickel alloyed with aluminum, silicon, and/or manganese. This wire will satisfy the foregoing requirements.

As shown in FIG. 1, elongated core 3 is composed of central element 1 covered by ferrite layer 2. Resistance wire 5 is helically wound therearound. Insulation layer 6 is coated on resistance wire 5 and core 3. Reinforcing mesh 7 is located on insulation layer 6 and protective sheath 8 surrounds the entire structure.

Central element 1 is preferably the result of twisting three aramid fibers, each of which is approximately 1,000 denier. The ferrite powder is blended with a fluorine rubber and extrusion coated on central element 1 to produce elongated core 3 having a maximum external diameter of 1.3 mm.

As to resistance wire 5, it has a diameter of 45 to 70 $\mu$m and a resistivity of 10 to 50 $\mu\Omega$cm and is applied at a pitch of at least 7,000 turns per meter. As a result, the resistance of the cable is 2 to 4 k$\Omega$/m. The composition of resistance wire 5 is advantageously a nickel alloy which contains approximately 5% by weight of each of aluminum, silicon, and manganese. The commercial product "Silbright 95" (produced by Silver Doki Co., Ltd.) meets these requirements.

Insulation layer 6 is preferably of silicon rubber and, after coating, has a desirable maximum external diameter of 4.6 mm. Reinforcing mesh 7 is the result of braiding 24 glass fibers and is, in turn, covered by sheath 8 which is also of silicon rubber. The total external diameter of the sheathed cable is 7 mm.

Thus, in accordance with the present Invention, the coil-type cable, useful in connection with lean-burn engines, possesses low resistance, withstands high voltage, and is capable of suppressing noise. More specifically, the inductance of the resistance wire is maintained at at least prior art levels without increasing the diameter thereof and without reducing the number of turns per unit length. As a result, the cable of the present Invention has both the necessary reduced resistance and the desired other characteristics of previously known cables.

While only a limited number of specific embodiments of the present Invention have been expressly disclosed, it is, nonetheless, to be broadly construed and not to be limited except by the character of the claims appended hereto.

What we claim is:

1. A noise-suppressing, coil-type, high voltage-resistant electrical cable comprising an elongated core, a resistance wire helically wound around said core in a direction perpendicular to an axis thereof, and an insulation layer on said core and said resistance wire, said resistance wire having a breaking strength of at least 100 grams force, an elongation to break of at least 15%, a diameter of about 45 to 70 $\mu$m, and a resistivity of about 10 to 50 $\mu\Omega\cdot$cm, said cable having at least 7,000 turns/meter of said wire wound around said core, and a resistance value of about 2 to about 4 k$\Omega$/m, said resistance wire comprising nickel alloyed with at least one metal selected from the group consisting of aluminum, silicon, and manganese.

2. The cable of claim 1 wherein said nickel is alloyed with 5% of each of aluminum, silicon, and manganese.

3. The cable of claim 1 wherein said core comprises a central element composed of a plurality of fibers.

4. The cable of claim 3 wherein said fibers are twisted together.

5. The cable of claim 3 wherein said central element comprises three aramid fibers.

6. The cable of claim 1 wherein said core comprises a central element covered by a ferrite layer.

7. The cable of claim 6 wherein said ferrite layer is a mixture of ferrite powder and a material comprising resin or rubber.

8. The cable of claim 1 wherein said insulation layer is comprised of silicon rubber.

9. The cable of claim 1 wherein there is a fiber mesh surrounding said insulation layer.

10. The cable of claim 9 wherein there is a sheath surrounding said fiber mesh.

11. The cable of claim 9 wherein said mesh is of glass fibers.

12. The cable of claim 1 wherein there is a sheath surrounding said core and said resistance wire.

* * * * *